United States Patent [19]

Melton et al.

[11] 4,152,084

[45] May 1, 1979

[54] PORTABLE FLOOR FINISH APPLICATOR

[75] Inventors: Joseph E. Melton; Glenn G. Lorch, both of Grand Rapids, Mich.

[73] Assignee: Melton Systems, Inc., Grand Rapids, Mich.

[21] Appl. No.: 758,828

[22] Filed: Jan. 12, 1977

[51] Int. Cl.[2] ..... A46B 11/04; A47L 13/22

[52] U.S. Cl. ..... 401/188 R; 401/288; 401/285; 401/270; 15/229 AP

[58] Field of Search ..... 401/188, 282–289, 401/48; 15/229 AP

[56] References Cited

U.S. PATENT DOCUMENTS

| | | | |
|---|---|---|---|
| 903,311 | 11/1908 | Peter | 401/48 |
| 972,898 | 10/1910 | Montgomery | 401/285 |
| 1,710,550 | 4/1929 | Nordlum | 15/52 |
| 1,920,069 | 7/1933 | Endly | 401/283 X |
| 2,374,170 | 4/1945 | Brennan et al. | 15/229 AP |
| 2,718,022 | 9/1955 | Jones | 401/288 |
| 2,756,449 | 7/1956 | Dewey | 401/285 |
| 2,979,756 | 4/1961 | Wallis | 15/546 |
| 3,377,639 | 4/1968 | Stevenson | 15/98 |
| 3,457,015 | 7/1969 | Taber | 401/48 |
| 3,776,645 | 12/1973 | Walker | 401/188 |
| 3,981,596 | 9/1976 | Melton | 401/48 |

FOREIGN PATENT DOCUMENTS 399174 9/1933 United Kingdom.

OTHER PUBLICATIONS

Advertizing Literature, "Drico Pressure Wax Applicators", 7/30/76.

Advertizing Literature, "The New E-Z Way Applicator".

*Primary Examiner*—Stephen C. Pellegrino

*Attorney, Agent, or Firm*—John A. Waters

[57] ABSTRACT

A portable floor finish applicator includes a pressurized liquid finish storage tank carried by a shoulder harness on the operator's back and a hand carried floor finish applicator comprising a hollow elongated handle and an applicator head mounted on the lower end of the handle. The applicator includes a liquid finish outlet tube for dispensing liquid finish uniformly over the surface of an applicator frame and wick applicator mounted on the underside of the applicator frame. Finish is applied through the wick by contact of the soaked wick with the floor. For water emulsion finishes, the wick applicator can be formed of a natural or synthetic lambs wool or it can be a flexible absorbent fibrous yarn material attached to a mesh backing material that permits liquid finish to flow readily through the backing. A flexible conduit conveys liquid finish from the outlet of the storage tank through a manually operable flow control valve at the upper end of the handle and then downwardly at least partially through the handle to the liquid finish outlet tube.

9 Claims, 6 Drawing Figures

PORTABLE FLOOR FINISH APPLICATOR

BACKGROUND OF THE INVENTION

1. Field of the Invention

This invention relates to a floor finish applicator and more particularly to a portable, hand carried floor finish applicator.

2. State of the Prior Art

A floor finish applicator for applying a finish to a floor is disclosed in applicant's U.S. Pat. No. 3,981,596. This apparatus includes a wheeled frame that is rolled along the floor, with wax or other finish being applied to the floor by means of a finish spreader that is dragged along the floor behind the frame. This apparatus is particularly suitable for large floor areas, such as shopping malls, schools, or the like.

There are applications, however, where the floor area is such that the size and the expense of applicant's wheeled floor finish applicator are not warranted. It is an object of the present invention to provide a simplified, manually operable finish applicator that is simple to operate, inexpensive, and economical and yet is effective in applying a superior coating of floor finish to a floor.

SUMMARY OF THE INVENTION

In accordance with the present invention, a portable floor finish applicator comprises a portable, pressurizable liquid finish storage tank for holding liquid finish, and a hand carried finish applicator comprising an applicator head mounted on an elongated, hand operated handle. The applicator head includes a porous wick mounted on the underside of an applicator frame for engagement with the floor. A conduit conveys liquid finish from the storage tank to a liquid finish outlet tube on the applicator head that dispenses liquid finish on the upper side of the wick, with the wick being sufficiently porous to permit enough liquid finish to pass therethrough to provide an adequate covering for the floor as the wick is manually moved over the floor. A manually operable flow control valve controls the flow of liquid through the conduit to the liquid dispensing outlet.

For water emulsion finishes (e.g., a wax or similar finish) the wick applicator can be formed for densely bunched strands of absorbent yarn material attached to a porous backing material. Desirably, the backing material is formed of a mesh fabric that readily permits flow of liquid finish through the backing into the absorbent yarn material. A pocket extends upwardly from the periphery of the backing to retain liquid finish over the backing and prevent liquid finish from flowing over the edge of the wick.

For applying solvent finishes (e.g., varnish, polyurethane or the like) as well as water emulsion finishes, a synthetic or natural lambs wool applicator having a porous or perforated backing is employed.

Desirably, the handle of the applicator is a hollow tubular member and the manually operable valve is mounted on the upper end of the handle, with a lever handle conveniently positioned for operating the valve. One section of the conduit leads from the tank to the valve and the other section of the conduit leads from the valve through the hollow handle to a position adjacent the lower end thereof, where it emerges from the handle and is connected to a liquid dispensing outlet tube.

These and other advantages and features of the present invention will hereinafter appear in connection with the exemplary embodiment of the present invention described below and shown in the appended drawings.

DETAILED DESCRIPTION OF PREFERRED EMBODIMENT

Figure 1:
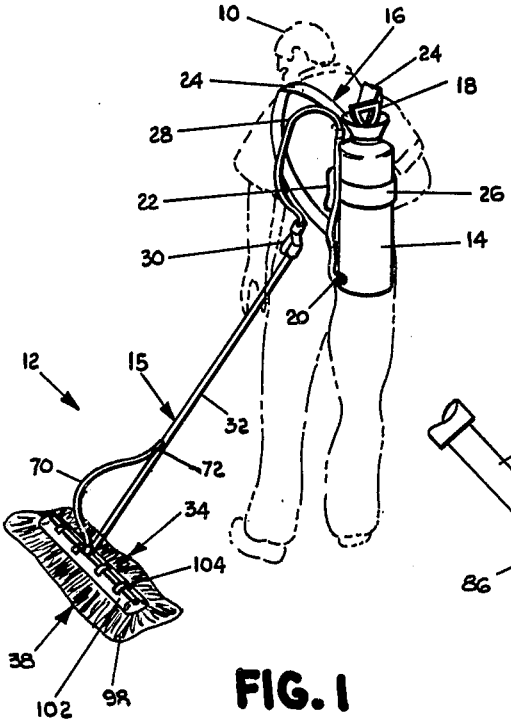
FIG. 1 is a perspective view showing an operator employing the portable floor finish application of the present invention.
Figure 2:
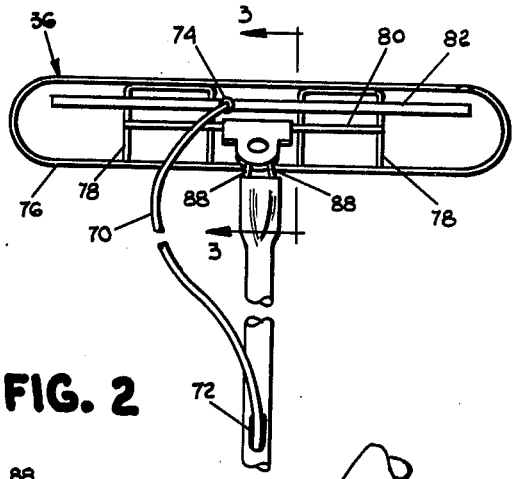
FIG. 2 is a broken plan view showing the lower end of the handle and applicator frame of the present invention.
Figure 3:
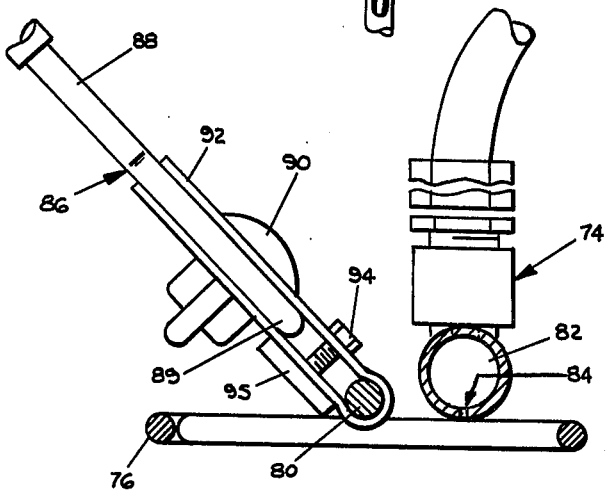
FIG. 3 is a sectional view taken along line 3 of FIG. 2.

Referring now to the drawings, an operator 10 is shown in FIG. 1 employing a finish applicator 12 constructed in accordance with the present invention.

Finish applicator 12 comprises a portable, pressurizable tank 14 and a hand-carried finish applying device 15. Tank 14 is mounted on the operator's back by means of a shoulder harness apparatus 16. The tank includes a hand operated pressure pump 18 for pressurizing the tank and a liquid finish outlet 20 for dispensing liquid finish from the tank. The pressure pump 18 can be removed so as to provide an inlet in the tank for filling the tank.

The shoulder harness apparatus 16 comprises a back plate 22 positioned in the middle of the operator's back, with shoulder straps 24 extending over the operator's shoulders and under his arms. An adjustable annular band 26 is attached to the back plate for encircling and holding the tank in place, in the manner shown in FIG. 1. The shoulder harness and back plate construction are conventional.

An outlet conduit 28 extends from the liquid finish storage tank to a flow control valve mechanism 30 mounted on the upper end of a handle 32 of finish applying device 15. At the lower end of handle 32, an applicator head 34 is mounted. Applicator head 34 comprises an applicator frame 36 mounted transversely on the lower end of the handle, with a removable wick applicator 38 being mounted on the underside of the applicator frame.

Figure 4:
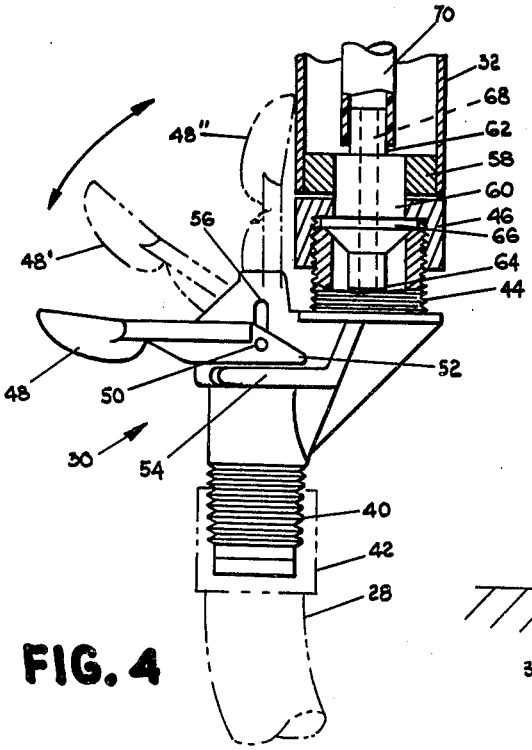
FIG. 4 is a broken view shown partially in section, showing the manually operable valve element of the present invention.

Valve 30 is a manually operated flow control valve of conventional design. In the present invention, flow control valve 30 includes a threaded inlet 40 for receiving liquid finish from the storage tank through conduit 28. A threaded fitting 42 of conventional design is employed for attaching the conduit to the inlet of the valve. Valve 30 also includes a threaded outlet 44 which is threadably engaged in a nut 46 on the upper end of the handle 32. Valve 30 is actuated by means of a pivotable lever 48. Lever 48 is pivotable by means of a pin 50 between a closed positioned designated by numeral 48, an intermediate positioned designated by numeral 48', and an open position designated by numeral 48'', as shown in FIG. 4. Pivotable movement of the lever causes a cam surface 52 on the end of the lever to engage a flange 54 on the valve. Engagement of the cam surface with the flange causes pin 50 to slide upwardly (FIG. 4 orientation) in a slot 56. Upward movement of the pin in the slot serves to gradually open a valve element in the interior of the valve (not shown).

Handle 32 preferably is of tubular design, so that the liquid finish can be conveyed to the applicator head through the interior of the tube. In the embodiment shown, the upper end of the handle includes a collar 58 attached securely in the upper end of the handle and a fitting 60 attached securely in the interior of the collar. Fitting 60 has a boss 62 on the inside end and a boss 64 on the outside and a flange 66 extends outwardly on the fitting adjacent the outside end.

Flange 66 engages and retains nut 46 on the end of the handle while permitting the nut to be rotated in order to engage flow control valve 30. Fitting 60 is provided with an opening 68 therethrough for the flow of liquid floor finish.

A conduit 70 is attached to the boss 62 and leads downwardly through the hollow interior of the tube to an outlet opening 72 adjacent the lower end of the handle. Conduit 70 then extends downwardly into engagement with the threaded fitting 74 on the applicator head.

Applicator frame 36 is formed of welded metal rod material and includes a flat oval outer ring 76 and U-shaped cross braces 78 supporting the front and back sides of the ring. A mounting rod 80 is attached to the U-shaped cross braces 78. An outlet tube 82 for liquid finish also is mounted on the U-shaped cross braces and extends laterally across the top of an applicator frame 36. Outlet tube 82 includes a threaded inlet fitting 74 leading to the interior of the tube and a plurality of outlet openings 84 spaced along the bottom of the tube so as to distribute liquid evenly over the top of the frame.

Handle 32 is connected to the applicator frame by means of a wire loop connector 86 having legs 88 which are pressed in the hollow end of the tube. A loop 89 formed at the outer end of the connector fits over a fastener 90 that extends through a U-shaped plate bracket 92 such that the end of the loop connector is pressed between the opposing sides of the bracket. The U-shaped plate bracket fits over mounting rod 80 such that the handle can be pivoted in a vertical plane around the axis of mounting rod 80. A threaded fastener 94 extends through the plate bracket into a nut 95 adjacent the mounting rod in order to permit the bracket to be tightened around the mounting rod at any given vertical position. The pivotable mounting mechanism permits the applicator frame to be maintained in a position parallel to the floor.

Figure 5:
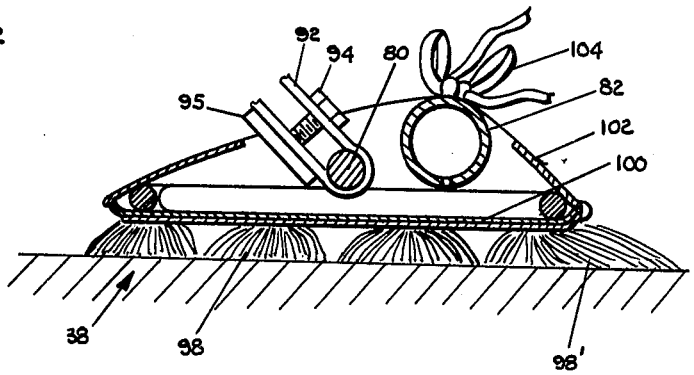
FIG. 5 is a sectional view similar to FIG. 3 showing the manner in which the yarn wick applicator is mounted on the applicator frame in the present invention.

Wick applicator 38 is formed of a flexible, absorbent floor engaging material 98, which is attached to a backing 100. A flexible fabric pocket 102 extends upwardly from the backing around the outer periphery thereof over the edges of the applicator frame so as to retain liquid finish from spilling over the edge of the applicator. Cloth ties 104 or the like extending from opposite sides of the pocket are used to tie the wick applicator on the applicator frame, in the manner shown in FIG. 5.

The construction of the wick applicator is an important aspect of the present invention. Since floor finish is applied to the floor through the backing of the wick applicator, it is necessary that the backing of the wick applicator be sufficiently porous to permit the finish to flow freely through the backing. Conventional cloth backing, such as that found on cotton dust mops having yarn floor engaging materials attached thereto, are insufficiently porous to permit enough floor finish (e.g., a water emulsion wax finish) to provide a sufficient coating for the floor as the applicator is moved over the floor.

In order to provide desirable flow characteristics for the applicator, in the present application, backing 100 is formed of a mesh fabric such as a nylon mesh material. Desirably, two layers of nylon mesh material are employed.

The wick material 98 is attached to the nylon mesh backing by being sewn to the backing in a customary manner. For applying a water emulsion wax finish, it is desirable to use a cotton yarn applicator. The yarn material used in such an applicator is similar to the cotton yarn material used in a conventional cotton dust mop, but the yarn material desirably is substantially more dense in the applicator of the present invention in order to provide an adequate wicking effect and to make the saturated wick heavy enough such that the saturated wick acts as a squeegee in spreading the liquid finish out over the floor.

In the preferred practice of the present invention, a 30 inch×4 inch cotton wick contains sufficient cotton yarn material such that the entire wick weighs about one pound. In such an applicator, the yarn is sufficiently dense that the applicator holds three-fourths ($\frac{3}{4}$) of a gallon of wax (about six pounds of wax) when fully soaked. Desirably, the strands 98 are each about two inches long over most of the applicator, with the strands 98' on the side opposite the operator being longer so that the strands trail the mop when the mop is pulled toward the operator. This enhances finish applying and spreading. Preferably, the strands 98' on the opposite side of the applicator are about six inches long.

Figure 6:
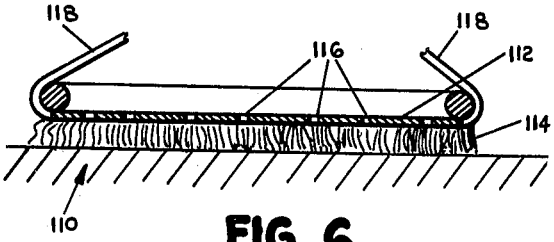
FIG. 6 is a sectional view similar to FIG. 5 showing a lambs wool applicator mounted on the applicator frame of the present invention.

While a cotton yarn applicator can be employed for applying a water emulsion wax finish to a floor, other types of applicators could also be used. For example, a synthetic or natural lambs wool applicator 110, shown in FIG. 6, can be employed for applying a solvent finish such as varnish, polyurethane, or the like as well as a water emulsion finish. A synthetic lambs wool applicator formed of Kodel fiber is particularly effective in applying solvent finishes. An applicator of this type includes a natural lamb skin or other backing 112 with attached synthetic or natural lambs wool 114 or similar fibrous material serving as a floor contact surface. For natural lambs wool or synthetic materials with non-porous backings, the backings are perforated with a plurality of holes or openings 116 to provide passageways for liquid finish to flow downwardly through the backing into the fibrous material below the backing. A sufficient number of holes can be provided in the backing to provide an adequate finish flow through the applicator. A pocket 118 substantially the same as pocket 102 is attached to the top of the backing.

The floor finish applicator of the present invention is operated in the following manner. Pressure pump 18 is removed from tank 14 and liquid finish is poured into the tank. The pump is then reinserted into the tank. Conduit 28 is connected to the inlet of flow control valve 30. A clean applicator is fastened on the applicator frame. The tank is pumped up manually and fastened by means of a shoulder harness on the back of the operator of the finish applicator. The operator then opens a lever to initiate wax flow to the wick material. Wax flows through the backing of the wick and saturates the wick material. The wick material is moved over the floor to apply the floor finish to the floor. Sufficient wax is continuously applied through the wick material so that the wick remains sufficiently saturated to continuously supply a smooth layer to the floor.

After the waxing operation is completed, the flow control valve is closed, the tank is removed from the operator's back and depressurized and the wick applicator removed from the applicator frame and washed. A liquid finish such as a water emulsion finish need not be removed from the tank and can be left in the tank for subsequent floor finish operations.

It should be understood that the foregoing represents merely an exemplary embodiment of the present invention and that various changes and and modifications can be made in the arrangements and details of construction of the elements described and shown herein without departing from the spirit and scope of the present invention.

The embodiments of the invention in which an exclusive property or privilege is claimed are defined as follows:

1. Portable floor finish applicator means for applying a finish to a floor comprising:

portable, pressurizable liquid finish storage tank means for holding liquid finish, said storage tank means comprising means for carrying the storage tank means and means for pressurizing the storage tank means, said storage tank means further comprising inlet means for receiving liquid finish and outlet means for dispensing liquid finish under pressure; and hand carried finish applying means including an elongated handle and an applicator head mounted on an end of the handle for engagement with the floor, the applicator head including an applicator frame attached to the handle and a flexible absorbent wick mounted on the underside of the applicator frame so as to be engageable with the floor, the applicator head further comprising liquid finish outlet means for dispensing liquid finish on the upper side of the wick, the wick being formed such that liquid finish dispensed on the upper side of the wick soaks into and through the wick and is dispensed on the floor by contact between the soaked wick and the floor, the wick being sufficiently porous to permit enough liquid finish to pass through the wick to provide an adequate finish covering for the floor as the wick is manually moved over the floor, the wick being formed of a plurality of strands of fibrous yarn material attached to an open mesh fabric backing material having a pluarlity of openings therein, the openings permitting liquid finish to flow readily through the backing into the absorbent fibrous yarn material, the wick further including a pocket attached to the outer periphery of the upper side of the backing such that liquid finish dispensed on the backing material is contained over the backing material and prevented from flowing over the edges of the wick.

2. Portable floor finish applicator means according to claim 1 wherein the yarn material is cotton yarn having strands about two inches long at least along one side thereof, the cotton yarn being sufficiently densely bunched on the backing such that the wick, when soaked, acts as a squeegee in spreading the finish on the floor.

3. Portable floor finish applicator means according to claim 2 wherein the strands on one side of the wick are longer than the strands on the other side, the longer strands being about six (6) inches long and the shorter strands being about two (2) inches long, the longer strands being positioned on the side of the applicator head away from the operator so as to be dragged behind the applicator head in applying finish to the floor, the longer strands enhancing the spreading of finish on the floor.

4. Portable floor finish applicator means according to claim 1 wherein the handle is a hollow tubular member having upper and lower ends, with the applicator head being mounted on the lower end and the valve means being mounted on the upper end, the valve means having an inlet outside the handle and an outlet inside the handle, the conduit means having one section extending from the storage tank means to the inlet of the valve means, the conduit means having a second section extending at least partially through the interior of the tubular member from the outlet of the valve means to the liquid finish outlet means at the applicator head.

5. Portable floor finish applicator means according to claim 1 wherein the liquid finish storage tank means includes a hand pump for pressurizing the storage tank means, and the means for carrying the storge tank means comprises harness means for mounting the tank on the back of the operator of the floor finish applicator.

6. Portable floor finish applicator means according to claim 5 wherein the harness means comprises a back plate positionable in the middle of the back of the operator, with flexible shoulder harness means for carrying the back plate on the back of the operator, the back plate including a retaining strap for attaching the tank to the back plate.

7. Portable floor finish applicator means according to claim 1 wherein the applicator frame is an elongated, flat frame having openings therethrough for permitting liquid finish flow through the frame, and the liquid finish outlet means comprises a perforated, hollow tube means positioned over the frame for dispensing liquid finish over the top of the frame.

8. Portable floor finish applicator means for applying a finish to a floor comprising:

portable, pressurizable liquid finish storage tank means for holding liquid finish, said storage tank means including hand pump means for pressurizing the tank and shoulder harness means for carrying the tank on the back of an operator, said storage tank means including inlet means for receiving liquid finish and outlet means for dispensing liquid finish under pressure;

hand carried finish applying means including a manually operable elongated tubular handle having upper and lower ends and a hollow interior extending at least through a portion of the handle, an applicator head being mounted on the lower end of the handle, said applicator head comprising an elongated, flat applicator frame pivotably mounted on the end of the handle such that the frame can be positioned in parallel alignment with the floor, a liquid finish outlet tube being attached to the applicator frame and having an inlet for liquid finish and outlet means therein for distributing liquid finish uniformly over the applicator frame, the applicator frame being provided with sufficient openings to permit liquid finish to pass through the applicator frame, a yarn wick applicator being removably mounted on the underside of the applicator frame, the yarn wick applicator including a plurality of strands of flexible absorbent yarn material attached to a backing material, with the backing material being formed of a mesh fabric that permits free flow of liquid finish through the backing, pocket means being formed on a upper side of the backing for containing liquid finish dispensed from the outlet means over the backing and preventing such liquid finish from flowing over the edge of the wick, said wick further including releasable tie means for attaching the wick to the applicator frame;

manually operable valve means mounted on the upper end of the handle, said valve means comprising manually operable lever means for controlling the flow of liquid to the valve means, said valve means including an inlet for liquid finish and an outlet for liquid finish, the outlet for liquid finish being positioned in the interior of the tubular handle;

upper conduit means extending from the outlet means of the liquid finish storage tank means to the inlet means of the valve means for conveying liquid finish from the storage tank means to the valve means; and lower conduit means attached to the outlet means of the valve means in the interior of the handle means and extending through at least a portion of the interior of the handle means and then outwardly through the handle to the inlet of the liquid finish outlet tube.

9. Portable floor finish applicator means for applying a finish to a floor comprising:

portable, pressurizable liquid finish storage tank means for holding liquid finish, said storage tank means comprising means for carrying the storage tank means and means for pressurizing the storage tank means, said storage tank means further comprising inlet means for receiving liquid finish and outlet means for dispensing liquid finish under pressure; and hand carried finish applying means including an elongated handle and an applicator head mounted on an end of the handle for engagement with the floor, the applicator head including an applicator frame attached to the handle and a flexible adsorbent wick mounted on the underside of the applicator frame so as to be engageable with the floor, the applicator head further comprising liquid finish outlet means for dispensing liquid finish on the upper side of the wick, the wick being formed such that liquid finish dispensed on the upper side of the wick soaks into and through the wick and is dispensed on the floor by contact between the soaked wick and the floor, the wick being sufficiently porous to permit enough liquid finish to pass through the wick to provide an adequate finish covering for the floor as the wick is manually moved over the floor, the wick comprising a synthetic or natural lambs wool applicator attached to a backing, the backing being porous or having opening means therein for conveying liquid finish through the backing, pocket means being attached to the upper side of the backing for retaining dispensed finish over the backing until it seeps through the backing into the lambs wool.

* * * * *